US005323573A

United States Patent [19]

Bakewell, III

[11] Patent Number: 5,323,573

[45] Date of Patent: Jun. 28, 1994

[54] BUILDING STRUCTURE AND METHOD OF ERECTING IT

[75] Inventor: Edward L. Bakewell, III, Creve Coeur, Mo.

[73] Assignee: Hypertat Corporation, St. Louis, Mo.

[21] Appl. No.: 748,270

[22] Filed: Aug. 21, 1991

[51] Int. Cl.[5] ..... E04B 1/32; E04G 21/14

[52] U.S. Cl. ..... 52/86; 52/223.7; 52/745.08

[58] Field of Search ..... 52/86, 87, 89, 745.07, 52/745.08, 747, 227, 228, 229, 309.7, 309.16, 566, 567, 270, 271, 266

[56] References Cited

U.S. PATENT DOCUMENTS

| | | | |
|---|---|---|---|
| 1,723,216 | 8/1929 | Stam | 52/227 |
| 2,378,275 | 6/1945 | Williamson . | |
| 2,874,812 | 2/1959 | Clevett, Jr. | 52/86 |
| 3,043,054 | 7/1962 | Schmidt . | |
| 3,310,917 | 3/1967 | Simon . | |
| 3,810,337 | 5/1974 | Pollard | 52/724 |
| 3,815,307 | 6/1974 | Tantlinger . | |
| 3,974,601 | 8/1976 | Steadman | 52/227 |
| 3,984,950 | 10/1976 | Hildebrand et al. . | |
| 4,023,317 | 5/1977 | Bettger et al. . | |
| 4,071,985 | 2/1978 | Wickwire . | |
| 4,071,986 | 2/1978 | Wickwire . | |
| 4,294,051 | 10/1981 | Hughes, Jr. | 52/228 |
| 4,343,125 | 8/1982 | Shubor . | |
| 4,403,980 | 9/1983 | Simpson et al. . | |
| 4,641,468 | 2/1987 | Slater . | |
| 4,731,279 | 3/1988 | Isshiki . | |
| 4,774,794 | 10/1988 | Grieb . | |
| 4,887,397 | 12/1989 | Peterson . | |
| 4,890,437 | 1/1990 | Quaile . | |
| 4,903,446 | 2/1990 | Richards et al. | 52/223 R |
| 4,907,383 | 3/1990 | Winter, IV . | |

FOREIGN PATENT DOCUMENTS

| | | |
|---|---|---|
| 292650 | 9/1967 | Australia . |
| 0091534 | 10/1983 | European Pat. Off. . |
| 643355 | 9/1950 | United Kingdom . |
| 1049861 | 4/1966 | United Kingdom . |

*Primary Examiner*—Michael Safavi

*Attorney, Agent, or Firm*—Polster, Lieder, Woodruff & Lucchesi

[57] ABSTRACT

An easily transported and erected building structure formed of polystyrene foam blocks. The blocks are reinforced and held together by tension rods extending through the blocks and attached to connector boards between the blocks. Complex, habitable, highly energy-efficient structures are easily assembled and reassembled in various configurations by two workers without special skills or lifting equipment.

16 Claims, 3 Drawing Sheets

BUILDING STRUCTURE AND METHOD OF ERECTING IT

BACKGROUND OF THE INVENTION

This invention relates to a building structure formed of structural modules which form the walls and roof of the structure. The invention is particularly applicable to the type of structure disclosed in commonly assigned U.S. patent application Ser. No. 06/853,778, filed Apr. 18, 1986, to Michael E. Jantzen, now U.S. Pat. No. 5,060,426 and will be described as applied to such a structure, although in some of its aspects the invention is not limited to such structures. The disclosure of that patent is incorporated by reference.

Conventional portable, quick-erect buildings are either cumbersome to transport and erect, requiring cranes and/or trained crews, or else, like tents, are underinsulated and incapable of efficient environmental control, especially in harsh climates.

It has long been recognized as desirable to provide a building structure which is easy to transport, easy to erect, modular, easily custom-configured or reconfigured, energy-efficient, and cost-effective for numerous applications. The aforementioned invention of Michael E. Jantzen meets these requirements better than any previously-known structures. It would be desirable, however, to provide a wider span structure which is even more easily erected and which is more economical.

SUMMARY OF THE INVENTION

One of the objects of the present invention is to provide a building structure which is easy to transport, easy to erect, modular, easily custom-configured or reconfigured, energy-efficient, and cost-effective for numerous applications.

Another object is to provide such a structure which may provide many of the portability and deployment advantages of a tent in a rigid-walled, highly insulated building.

Another object is to provide such a structure which provides an attractive structure in a wide variety of configurations, and which may be used as a permanent structure or easily disassembled and reconfigured.

Another object is to provide methods of assembling such a structure which permit remarkably quick and easy erection of the structure, with as few as one or two workers.

Another object is to provide such methods which permit erection of the structure without any permanent framework and without any cranes or other external erection equipment.

Another object is to provide such methods which use portable internal scaffolding in erecting the structure and reuse the scaffolding as a part of the finished structure.

Other objects of the invention will be apparent to those skilled in the art in light of the following description and accompanying drawings.

In accordance with one aspect of this invention, generally stated, a modular building structure is provided comprising a plurality of structural foam blocks, each having a height and a width both greater than its thickness; a top plate on an upper face of the block; a bottom plate on a lower face of the block; and tension rods extending from the top plate to the bottom plate, the tension rods comprising attachment means for attaching the modules to each other.

Preferably, the plates are separate from the blocks so as to reduce the weight of the modules which must be handled. The openings extend entirely through the plates. The plates act to connect and transfer the stresses generated by the tension elements across the upper and lower faces of the modules.

The tension rods are used principally for connecting the modules, and due to the lever arm effect of the rods a gain in strength of the modules is attained analogous to the gain in strength contributed by the lever arm effect of the rods in post-tensioned concrete. The attachment plates are analogous to the anchor plates in post-tensioned concrete.

Preferably, the modules are voussoirs of the same general configuration as those of U.S. Pat. No. 5,060,426, and the modular building structure is in the form of a barrel vault. The structure may be formed from six-, eight- or ten- module arches, and an apex keystone of desired size and shape may be provided. Because the modules are easily cut with standard foam-cutting tools, changing the sizes of the module, and the angles of their upper and lower faces, is simplified. The plates may be made with a certain amount of play for the tension elements, to accommodate somewhat different geometries.

The use of foam blocks, connector plates and tension rods, rather than the plywood cabinet modules, hook-and-cove external connectors and internal clip connectors of the prior application, provides a number of advantages. For example, it greatly simplifies the manufacture and assembly of the structure, protects the connectors, simplifies sealing the external seams of the structure, provides easier connection of internal facings, provides a vapor barrier which is difficult to breach, and avoids the undue stresses associated with the screws holding the hook and cove of the prior construction, thereby increasing the practical size of the structure. It has been found that the modules are better able to withstand the loads inherent in a ten-module, twenty-two-foot wide arch. The structures have the same virtues as those of the previous Application, including the ability to assemble them easily into the same complex shapes, but the modules are lighter, hence much easier to work with.

End walls of the new structure are greatly simplified by making them external to the arches, rather than inset. Sealing the end walls to the arches is also much more efficient.

To accommodate tools for tightening the tension elements, the arch structures are preferably given a "keystone" of substantial dimensions, on the order of one to two feet. This keystone includes plates which extend above and below the arch modules and permits a wide variety of treatments, including ventilators, skylights, or other utility penetrations.

The modules may also be prefinished on their outer faces, their inner faces, or both, as may the plates. Therefore, fewer large parts are required to finish the structure. Because all connectors may be interior of the modules, and only the faces of the modules and the plates need be exposed, the joints of the structures may be finished with weather-resistant film- or metal-faced tapes.

The method of erecting a building structure in accordance with the present invention includes a first step of positioning a first module in a desired position, the module having an upper face and a lower face, a second step of tightening tensioning means extending from the upper face to the lower face of the first module to place the first module in compression, a third step of mounting a second module above the first module, the second module having an upper face and a lower face, and a fourth step of tightening tensioning means extending from the upper face to the lower face of the second module to place the second module in compression.

In erecting such a vault structure, in accordance with the present invention, a platform is preferably assembled which can support the modules as they are positioned, and which acts as a scaffolding for the person or persons assembling the modules. When the structure has been completed, the platform is attached to the interior of the structure to form one or more interior partitions, or it may be attached to the interior of the end walls if no partitions are required. The platform preferably comprises two lightweight vertical stud walls spanned by one or more removable decking panels.

Other aspects of the invention will be better understood in light of the following description of the preferred embodiment.

DESCRIPTION OF THE PREFERRED EMBODIMENT

Figure 1:
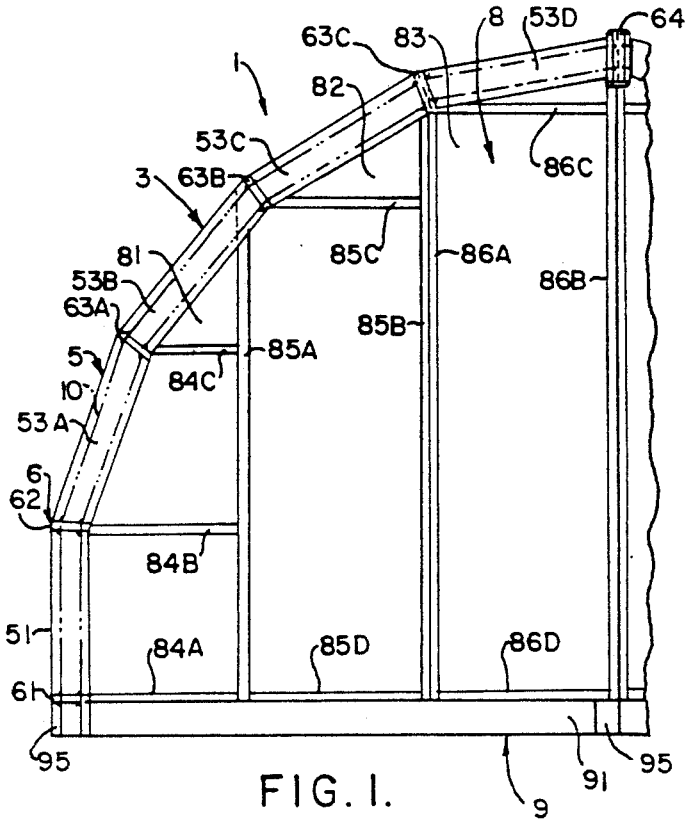
FIG. 1 is a fragmentary view in end elevation of a vault structure constructed in accordance with the present invention.
Figure 3:
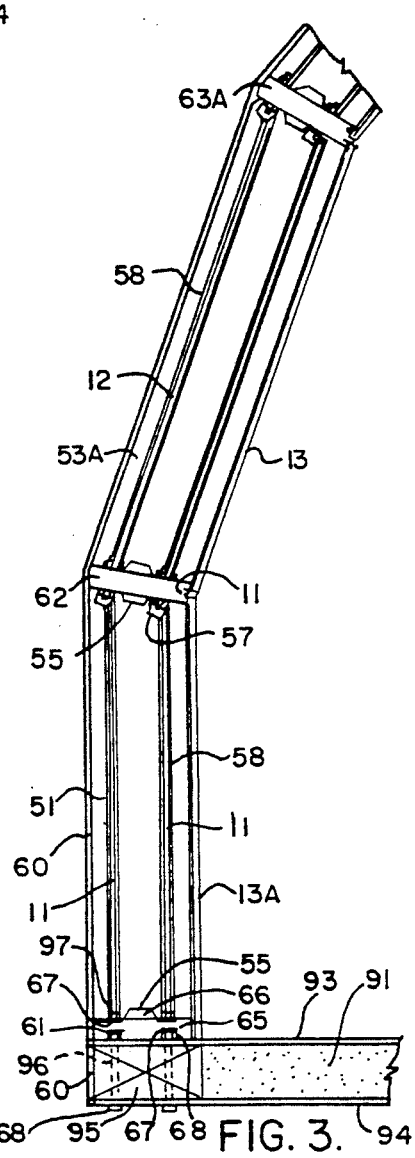
FIG. 3 is an enlarged of sectional view taken along the line 3—3 of FIG. 2.
Figure 2:
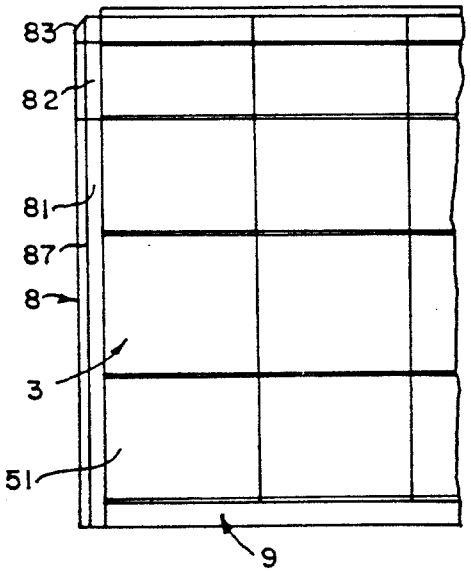
FIG. 2 is a fragmentary side elevational view of the vault structure of FIG. 1.
Figure 4:
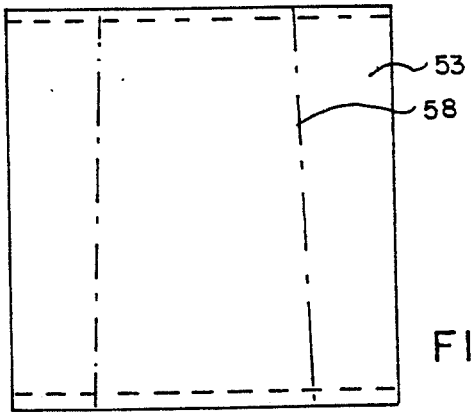
FIG. 4 is an interior view in side elevation of an arch module of the structure of FIGS. 1-3.
Figure 6:
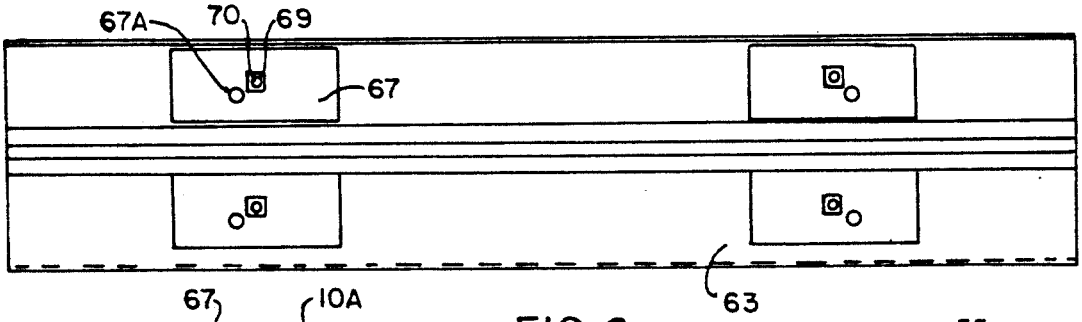
FIG. 6 is a view in top plan elevation of a connector plate part of the structure of FIGS. 1-3.
Figure 7:
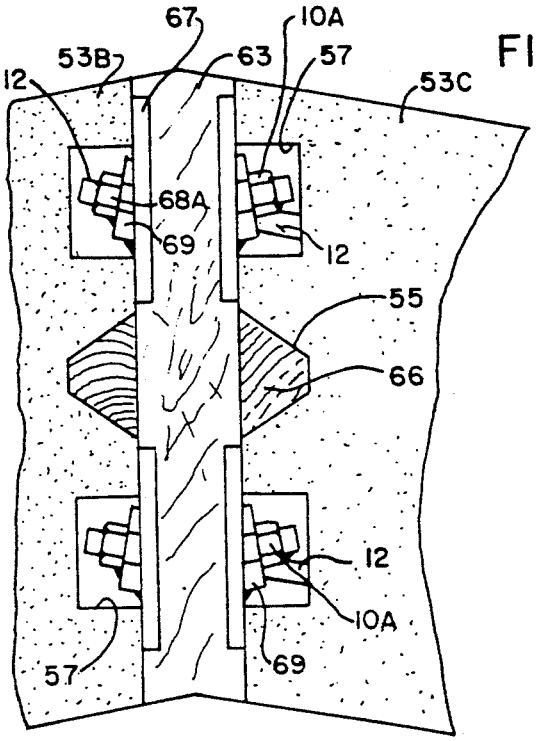
FIG. 7 is an enlarged detail of FIG. 2 showing the attachment of two modules, a connector plate and tension rods.
Figure 5:
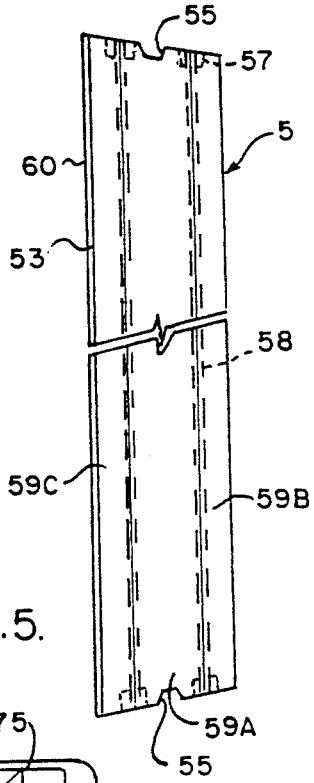
FIG. 5 is a view in end elevation of the module of FIG. 4.
Figure 9:
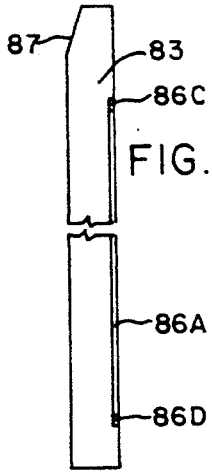
FIG. 9 is a view in side elevation of an end wall module of the structure of FIGS. 1-3.
Figure 8:
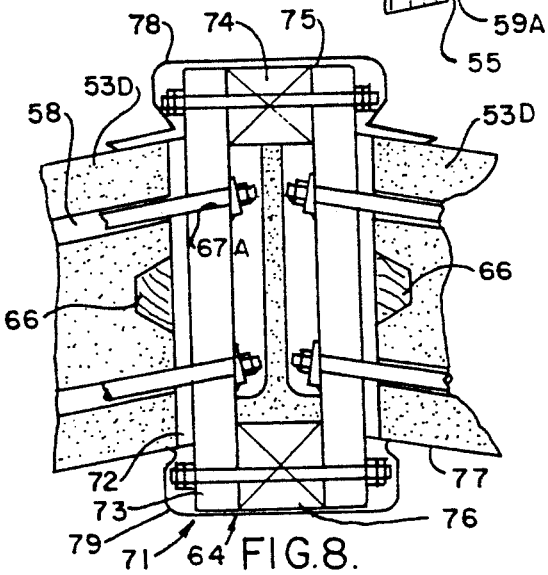
FIG. 8 is an enlarged detail, corresponding to FIG. 7, of a connection at the apex of the structure of FIGS. 1-3.

Referring now to the drawings, and in particular to FIGS. 1-2, reference numeral 1 indicates one illustrative embodiment of a structure in accordance with the present invention. The structure 1 includes several arches 3, each made of ten modules or voussoirs 5, end walls 8, and a floor 9. Each arch 3 has external dimensions of 22'-6.5" (6.87 meters) across, 12'-11.25" (3.94 meters) tall, and 48" (1.21 meters) wide, and internal dimensions of 21' (6.40 meters) across, 11'-10" (3.61 meters) tall, and 48" (1.21 meters) wide. The arches are thus substantially larger than those of the aforementioned Jantzen structure. Five-module half-arches may be formed and closed with vertical walls, and full arches can be butted to half-arches in a "T" as viewed from above, so that the half-arches and arches can be arranged in the same wide variety of structures as can the Jantzen structures.

As described in more detail hereinafter, each arch 3 is made of foamed plastic modules 5 separated by connector plates 6. The connector plates 6 separate the modules 5 and provide mounting points for steel rods 10 extending through the modules 5. The rods 10 hold the modules together and strengthen the arch 3.

The ends of the structure are closed by end walls 8 which, unlike those of the Jantzen structure, are mounted exterior of the arches. As shown in FIG. 1, the end walls 8 of each half arch include three panels, 81, 82, and 83.

The floor 9 of each half arch includes a single floor panel 91. The structure 1 may be mounted on a base frame, as is the illustrative Jantzen structure, or on a permanent foundation, or on a smooth, level surface.

Referring now to FIGS. 3-8 for a more detailed description of the arch 3, the modules 5 include a lower, parapet, module 51 and four identical modules 53A, 53B, 53C, and 53D. All of the modules have a width of 48" and a thickness of 9.25". The parapet module 51 is 3'-2.5" tall on its outside and 3'-0.75" tall on its inside. The lower face of the parapet module 51 is square with respect to the vertical walls of the module, and its upper face forms an angle of about 80° with respect to its outer face. The upper and lower faces of the module 51 include a groove 55 extending parallel with the inner and outer faces of the module 51. The groove 55 is proportioned to receive a key or tongue of a connector plate, as described hereinafter. The upper and lower faces of the module 51 also include four recesses 57 to accommodate rod ends and nuts, as also described hereinafter. Extending from the bottoms of the recesses 57 are four corresponding ⅝" holes 58 extending through the module from the upper face to the lower face. The holes 58 are spaced approximately two inches from the outer and inner faces of the module; they are spaced from the sides of the module 10.406" at the top of the module and 9.406" at the bottom of the module. Preferably, the module is formed as a sandwich of three plastic foam boards, a central board 59A which is 5" thick and two outer boards 59B and 59C, each 2" thick, adhered to each other with a structural adhesive. The adhesive and the exterior skin 60 add up to 0.25" to the overall thickness of the module. The holes 58 may then be formed as grooves in the abutting faces of the boards 59A, 59B, and 59C.

The upper modules 53 are identical with each other and are constructed in the same manner as the parapet module 51. Each module 53 is 3'-9.5" tall on its outside and 3'-6.3125" tall on its inside, so that the module is a regular trapezoidal prism whose upper and lower faces form an angle of about 10° with the outside face of the module. The upper and lower faces of the modules 53 include grooves 55 and recesses 57 corresponding to those in the parapet module 51, and four ½" holes 58 extend from the upper face to the lower face of the modules 53. The holes 58 are spaced the same distance from the outer and inner faces of the modules, and cant inwardly from bottom to top the same distance as their counterparts in the parapet module 51.

The modules 5 are made of a closed-cell extruded foam. The preferred foam is an extruded polystyrene sold by Dow Chemical Company, Midland, Mich., under the trademark Styrofoam. It has been found that structural grades of the foam are not required, the "square edge" "blue" material designed for wall, foundation and membrane roofing insulation being adequate for the construction to be described. The material has excellent insulating qualities, and provides modules 5 having a weight on the order of thirty pounds, making them easy for one person to handle. This material has well known, published properties, some of which are shown in Table 1, for a one-inch thick sample.

TABLE 1

| PROPERTY | ASTM test | Value |
|---|---|---|
| Strength (min.) (lb/in$^2$) | | |
| Compressive strength thickness direction | D 1621 | 25 |
| Compressive Modulus thickness direction | D 1621 | 1000 |
| Tensile Strength thickness direction | D 1623 | 50 |
| Tensile Modulus thickness direction | D 1623 | 1800 |
| Shear Strength length direction | C 273 | 30 |
| Shear Modulus length direction | C 273 | 450 |
| Flexural Strength length dimension | C 203 | 100 |
| Flexural Modulus length direction | C 203 | 3500 |
| Water resistance | | |
| Water Absorption | C 272 | 0.1 |
| % by volume (max) | D 2842 | 1.9 |
| Water Vapor Permeance perm | E 96 | 0.4–1.0 |
| Thermal resistance (R-value. °F. × ft$^2$ × h/Btu) | | |
| @ 75° F. mean temperature | C 518 | 5.0 |
| @ 40° F. mean temperature | C 518 | 5.4 |
| Density | | |
| Pounds per cubic foot | | 1.5 |
| | * * * | |

Similar properties are available in a closed cell, extruded polystyrene foam board sold by Amoco Foam Products Company as its AMOFOAM roof insulation, but this material is not presently available in thicknesses above four inches.

The modules 5 are constructed by adhering four-foot wide by eight-foot long boards 59A, 59B and 59C to each other to form an elongate block, then cutting the block with a hot wire at the appropriate angle to form two modules 5. Each of the modules 5 is then painted with an impact- and ultraviolet-resistant coating, such as an aliphatic polyurethane coating, to produce a film facing 60 on its outer surface for weather protection. The weight of the adhesive and coating increases the weight of the modules to about 2.0 to 2.5 pounds per cubic foot.

The connector plates 6 include a lower connector plate 61, a first module connector plate 62, three identical connector plates 63, and an apex connection 64. All of the connector plates 61–63 include a board 65 which is 48" long and approximately 9" wide. The board is preferably made of a high-strength laminated veneer lumber, such as the material sold by Trus Joint Corp. of Boise, Id., under the trademark Micro-Lam. The outer face of each connector plate 6 is coated with the impact- and weather-resistant film which covers the exterior of the modules.

The lower connector plate 61 is made of two one-inch thick Micro-Lam boards, adhered to each other. The lower connector plate 61 includes a central key or tongue 66, having a width of 1" at its base, adhered to the upper face of the board 65. On the lower face of the lower connector plate 61 are inset four 0.25" thick steel plates 67, to each of which is welded a nut 68 for receiving the end of a ½" rod 10 as described hereinafter. A vertical hole 67A extends from the top of the connector plate 61 to the nut 68. Each steel plate 67 is 7" long by 3.25" wide. Inset flush with the top of the lower connector plate 61 are four additional plates 67, having ⅝" openings in them to pass bolts for securing the connector plate 61 to floor structure 9.

The first module connector plate 62 is similar to the bottom connector plate 61. It includes two one-inch thick Micro-Lam boards adhered to each other, with both grains extending lengthwise of the boards, and keys 66 on both its upper and lower faces. The boards are beveled to form a convex angle on their outer face and a concave angle on their inner face, to form a smooth junction between the modules 5 outside and inside the structure 1. Four steel plates 67 are inset flush with the upper face of the connector plate 62, and four steel plates 67 are inset flush with the lower face of the connector plate 62. To each of these plates 67 is welded a steel wedge washer 69. A ⅝" hole 70 extends through the upper wedge washer 69, the steel plate 67, the connector plate 62, and the opposing plate 67. To the wedge washers 69 on the lower face of the connector plate 62 are welded ⅜" nuts 68A. A ½" hole extends through each upper steel plate 67, the connector plate 62, and the lower wedge washer 69, to its respective nut 68A.

The connector plates 63 are similar to the connector plate 62, but are made of two such three-quarters inch boards, yielding a 1.5" plate 63 rather than a 2" board. Thinner boards may be used because the stresses diminish above the parapet module. Also, all the holes are ½" in diameter to accommodate smaller rods 10.

The apex connection 64 is made of a connector plate 71 formed of a ½" thick oriented strand board 72 adhered to a 1" thick oriented strand board 73. The thinner board 72 is formed to be an extension of the upper module 53D and includes a key 66. The thicker board 73 is 13.25" wide, leaving a two-inch margin above and below the board 72. As described hereinafter, the margins of the board 73 provide a mean for attaching half arches to each other through spacer blocks to form a full vault or alternatively to a vertical wall to form a half vault.

The rods 10 are formed of standard ASTM A36 steel. The upper end of each rod includes a nut 10A welded to it to form a bolt head, and the lower end is threaded and tapered for easy piloting into a nut 68 or 68A. The lowermost rods 11 are ½" in diameter. Two of the rods 11 are 4" long, and the other two are 39.5" long. The rods 11 are preferably color coded to indicate the longer rods, although the rods can not be mistakenly attached in the wrong openings. The upper rods 12 are ⅜" in diameter. Two of the rods 12 are 49" long and the other two are 46" long.

Inner facing panels 13 are 48" wide. The lowermost facing panel 13A is 38" tall, and the other panels 13 are 43" tall. The panels 13 are made of ⅜" plywood with a high density polyethylene laminate surface. The facing panels 13 are attached with drywall screws to the inner faces of the connector plates, 61–63. The panels 13 provide additional strength to the arches 3 and also provide sufficient fire resistance to the structure 1 to meet most codes for inhabited structures of this category. The panels 13 may, if desired, be offset laterally with respect to the modules 5, to provide cross bracing for the structure 1.

The end panels 81–83 are formed of the same extruded foamed polystyrene as the arch modules 5. The end panels, however, are factory-formed by adhering a 6" thick board to a 3" thick board and do not include any continuous internal openings. The outer edges of the end panels are beveled as at 87 to reduce damage both in handling and in the finished structure. The inner face of the first end panel 81 has set into it three horizontal 1"×4" wood strips 84A, 84B and 84C, at the levels of the bottom connector plate 61, the first module connector plate 62, and the second module connector plate 63A. The strips 84 are set flush with the surface and held by adhesive. The second end panel 82 has set into its inner face two vertical edge strips 85A and 85B and horizontal strips 85C and 85D, at the level of bottom connector plate 61 and the second module connector plate 63B,respectively. The third end panel 83 has set into its inner face two vertical edge strips 86A and 86B and horizontal strips 86C and 86D, at the level of the bottom connector plate 61 and the third module connector plate 63C, respectively. The wood strips 84–86 act as mounts for connecting the end panels to the connector plates and to each other by standard connectors. They also act as convenient mounts for interior facing panels covering the ends 8.

The floor panel 91 is made of 6" thick polystyrene foam bead board with ⅜" oriented strand board skins 93 and 94 adhered to its upper and lower faces to form a stress-skin sandwich panel. The upper face of the upper skin 93 is provided with a polyethylene wear layer. Along the inner and outer edges of the panel 91 wood blocks 95 are set into the foam, between the skins 93 and 94. On the bottom of the outer blocks 95 are inset 0.25" thick steel plates 67, to each of which is welded a nut 68 for receiving the end of a ½" bolt 97. Holes 96 are drilled through the blocks 95 to the nuts 68, to permit bolts 97 through the bottom connector plates 61 to attach the bottom connector plates to the panel 91. The inner blocks 95 permit securing the abutting edges of the panels to each other or to a common support (not shown) below the floor without crushing the floor.

The bead board has a density of about 1.0 pounds per cubic foot, and the weight of the total panel 91 is on the order of 150–180 pounds, depending on the thickness of the wear layer.

The structure 1 is assembled as follows. The following assembly procedure is based on a twenty-two-foot wide structure, made with four arch sections and end walls to produce a total length of seventeen feet six inches.

On-site erection can be accomplished with as few as two workers.

On-site, a base is prepared, illustratively by erecting a framework of the type described in the previously-mentioned Jantzen patent. It will be understood that a suitable base may also be created by other, standard, methods such as by leveling a site or pouring a cement foundation.

The floor modules 91 are aligned, joined, and anchored by conventional methods. Preferably, a thin (⅛") expandable polyurethane foam tape, having an adhesive applied to one face, is applied between the modules 91 as they are assembled, to provide a tight gasketing between the modules. The gaskets are formed of an open cell, waterproofed, polyurethane foam. The foam has the characteristic of expanding to several times its original thickness when it is released from compression, so that all small variations in spacing between the modules are accommodated.

The lowermost (parapet) wall modules 51 may be pre-erected on the floor modules 91 before transportation, in order to conserve space and reduce on-site erection time. Whether pre-erected or erected on site, the bottom connector plate 61 is mounted to the block 95 in the floor by passing four bolts 97 through the plate 61 and holes 96 into the nuts 68 on the bottom of the block 95. Insulative spacers provide a thermal break between the bolts 97 and the metal plate 67 in the connector plate 61. The bolts are tightened with a manual or power torque wrench set at ten foot pounds, to secure the connector plate 61 to the floor module 91. The parapet arch module 51 is placed on the connector plate 61, and is aligned axially of the arch by inspection. Alignment of the module 51 inwardly and outwardly is set by the groove 55 in the module 51 and the key 66 on the connector plate 61. Connector plate 62 is placed on top of the parapet module 51 and similarly aligned. Long and short rods 11 with nuts 10A welded to their upper ends are inserted through the appropriate holes 70 in the upper wedge washer 69, through the connector plate 62, the holes 58 in the foam module 51, and the holes through the bottom connector plate 61, until they extend into the nuts 68 on the bottom of the connector plate 61. The tapered ends of the rods 11 guide the rods into the nuts and effect any necessary sliding adjustment of the position of the foam module 51. The rods are then tightened with a torque wrench set at ten foot pounds. A threadlocking compound is preferably preapplied to the nuts 68 to prevent loosening caused by vibration.

Figure 10:
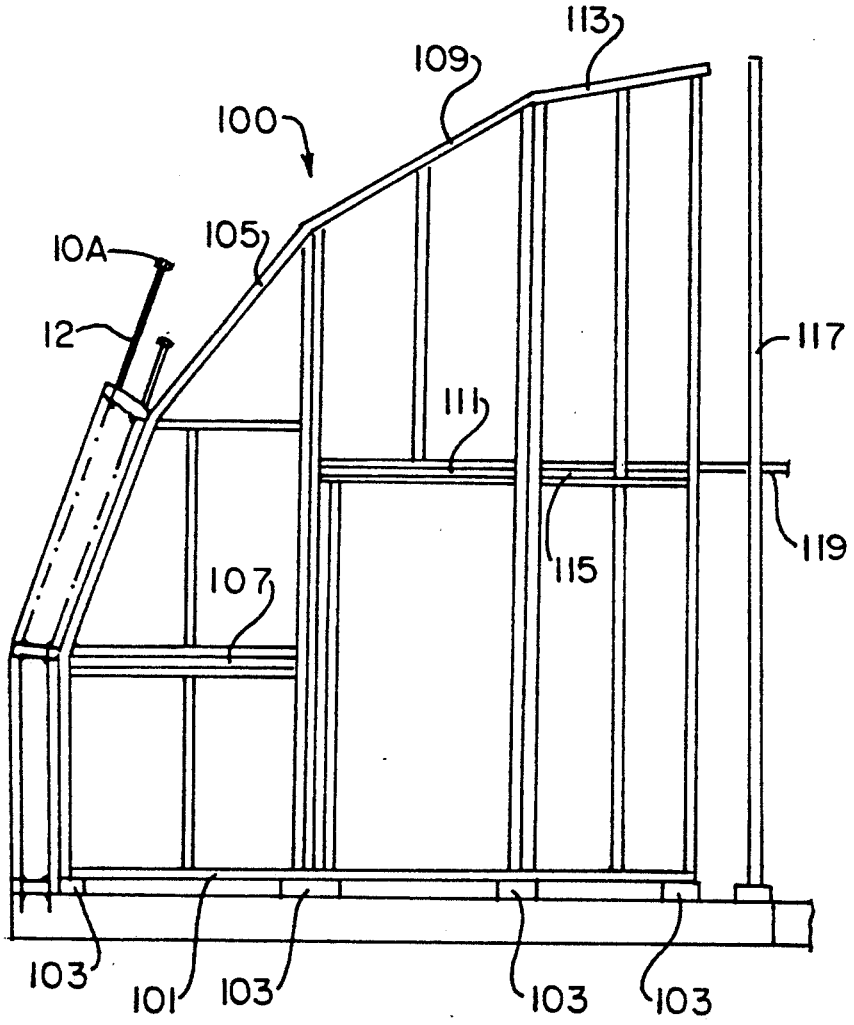
FIG. 10 is a view in side elevation corresponding to FIG. 1, showing a platform being used to support an arch structure and its modules as the arch is being built.

As shown in FIG. 10, a platform 100 is assembled on the floor 9 with drywall screws from seven modules made of light-weight two-by-four metal studs, two 9'-3" metal studs, and four sheets of plywood decking. The platform 100 acts as a scaffolding which supports the arch during erection and permits safe positioning of each block, even in high winds. After the arches are completed, the metal scaffolding reconfigures into a conventional partition wall within the building, and the plywood decking may be used as a facing material. In a small structure requiring no partition walls, the scaffolding may be used to reinforce and further insulate the end walls of the building structure.

The platform 100 includes two parallel base rails 101 which are laid on blocks 103 at right angles to a first parapet module 51, and even with the ends of the module 51 (that is, spaced 48" apart). A first platform assembly 105 is screwed to each rail 101 and to the first module connector plate 62. Each platform assembly 105 includes a pair of horizontal metal channels forming a slot for a first plywood deck sheet 107. A second platform assembly 109 is screwed to each first assembly 105 and to its rail 101. Each platform assembly 109 includes a pair of horizontal metal channels forming a slot for a second plywood deck sheet 11. A third platform assembly 113 is screwed to each second assembly 109 and to its rail 101. Each platform assembly 113 includes a pair of horizontal metal channels forming a slot for a third plywood deck sheet 115. A fourth platform assembly 117 is 48" wide and 12' tall, with appropriate cross-bracing for strength. It is set transverse to the assemblies 105, 109 and 113, and spaced a short distance from them near the center of the floor. Horizontal metal channels in the fourth assembly 117 support one end of a plywood deck sheet 119, the other end of which is supported on the third deck sheet 115. The scaffolding platform 100 is temporarily attached to a first parapet module 51 by two drywall screws.

The remaining four modules of the first half arch are lifted onto the platform. The modules weigh less than thirty pounds each. Therefore, one or two workers can easily lift each module.

One of the arch modules 53 is placed onto the wood attachment plate 62 on the parapet module by a worker standing on the plywood deck sheet 107. The arch module is supported and oriented by the platform. It is aligned visually lengthwise of the structure, and is self aligning in the other directions.

A wood attachment plate 63 is placed on top of the arch module, and two pairs of threaded rods 12 are inserted through continuous openings 70 and 58 in the wood attachment plate and arch module respectively, into threaded nuts affixed to the lower face of the first wood attachment plate. The rods are tightened with an electric torque wrench, preset to ten foot-pounds.

The interior plywood/laminate facing 13 on the arch module may be screwed to the wood attachment plate through predrilled holes, either at this time or after the structure has been completely assembled, to give added strength and fireproofing. The small gaps between facing panels 13 and 13A can be filled with vinyl extruded T-trim which may also cover the screw heads.

The third, fourth, and fifth arch modules are assembled in the same way, by a worker standing on the platform formed by plywood decking sheets 111, 115 and 119.

The decking sheet 119 is then pulled, leaving the frame 117 supporting the uppermost foam module 53D. Although the half arch is just self-supporting without the support 117, the support prevents damage to the half arch which might otherwise be caused by excessive loading before the structure is completed. Blocks 103 beneath the lower channels 101 are then removed, to lower all of the platform 100 except the frame 117. The platform is then swung around frame 117, blocks 103 are placed under it, and it is screwed to the opposing connector plate 62. Deck sheet 119 is slid back into the support 117.

The opposite half-arch is then constructed in the same manner. The fifth (uppermost) arch module of the second side of the arch is assembled by inserting rods 12 having nuts welded to their upper ends through the apex attachment plate 71 and the upper arch module 53D before the module is lifted into position. The weight of the combined module, plate, and rods is less than seventy-five pounds, and the platform 100 provides supports for raising the module primarily through sliding it along the upper rail of the platform 100. The upper foam modules 53D are spaced apart about 3", and the rods 12 must be tightened with a manual torque wrench.

Two 3" wood blocks 74 are then inserted between the upper margins of the boards 73 of the apex plates 7, and bolts 75 are inserted through predrilled holes. An elongate block of polystyrene foam, formed with recesses to accommodate the rods 12 and wedge washers 69, is inserted into the space between the boards 73. Lower wood blocks 76 are then placed between the lower margins of the boards 73 and bolts 77 are secured through predrilled holes.

The platform is then moved to one of the next parapet modules, and the next arch is assembled in the same manner. Self-adhesive, pre-compressed gaskets are applied to the exposed side of the arch before the adjacent arch modules are assembled. After release from their packaging, they slowly expand to fill the space completely.

If more than two workers are available for erection of the arches, two platforms 100 may be utilized to erect both halves of an arch simultaneously without need for support frame 117. With a double platform, two persons can erect a full arch on a prepared floor at the rate of one every ten minutes.

The end modules 81, 82, and 83 are mounted to the exterior of the arch at each end. Wood strips 84, 85, and 86 allow easy attachment of the end modules to the connector plates 61, 62, and 63 by angle brackets, and to each other by simple strap connectors. The top edge of each end module is connected to the ends of connector plates 61, 62, and 63A–C by screws extending through holes predrilled in their foam. The heads of the screws are captured in reinforced recesses in the outer faces of the end modules, and foam plugs fill the recesses. Similar predrilled holes permit the end modules to be screwed into the ends of the floor modules 91 of the first arch. If additional workers are available, they can assemble the first end while the second arch is assembled.

Exterior seams can also be taped by additional workers while subsequent arches are assembled. The seams are taped with commercially available weatherproof tape, such as a Tedlar tape sold by Minnesota Mining and Manufacturing Co. as its tape 838. access to the upper portions of the exterior of the arch may conveniently be gained by means of a rope ladder thrown over the structure.

The exterior of the apex connectors 64 is covered by a standard metal ridge flashing 78, which may be formed in multiple pieces and locked by the ends of the bolts 75 if desired.

The interior of the apex connectors 64 may be covered by a continuous C-shaped vinyl extrusion 79, held by the ends of bolts 77.

Half vault sections are erected in much the same manner. After a half arch has been assembled, a vertical wall is erected from rectangular foam blocks, held together in the same manner as the arch modules, with connector plates lacking wedge washers. Special apex connector plates of the half arch and the vertical wall are bolted together.

The completed building shows remarkable resistance to exterior loading, such as wind and snow loading. It provides very high insulative values, on the order of R-45; the extruded polystyrene foam has the remarkable property of providing higher R-values at subzero temperatures. It can be taken down and re-erected in different configurations repeatedly.

The structure can be erected easily by two persons without the need of any special lifting equipment such as cranes or winches. The heaviest panels are the floor sandwich panels 91, which need never be lifted far. The tallest end panels 83 weigh on the order of one hundred pounds. One end of the structure can be erected with the aid of any wind, and the other end will then be protected from the wind by the structure. None of the panels weighs over two hundred pounds.

Numerous variations in the structure and methods of the present invention, within the scope of the appended claims, will occur to those skilled in the art in light of the foregoing disclosure.

Merely by way of example, the structure may be made of eight-module arches, by the simple expedient of cutting the upper and lower faces of the foam arch modules at slightly different angles and resizing the end modules and floor modules. In a four-arch structure formed of such eight-module arches, the floor panels may be preassembled to form a first eight-foot by sixteen-foot "double marriage" pallet, and the remaining four floor panels are preassembled to form a second such pallet. The entire structure, including a modular bathroom, a modular kitchen, and the small amount of equipment needed for erecting the structure can be formed into two pallets having the dimensions of standard ISO containers (8'×8'×20'), with room remaining. The first pallet supports all the structure and erection equipment. The second pallet may be packed above or below the first pallet, to create a package which is about nine feet tall, or it may be factory equipped with interior services such as a pre-plumbed and pre-wired bathroom module, a kitchen module, and an HVAC system module and transported separately. These two pallets are transported and joined on site to produce the finished floor structure. Each loaded pallet is less than eight feet tall and each includes wood or metal runners for moving the pallet to the erection site and to space the floor from the site surface. With a platform which extends the entire width of the structure, and two workers on the platform, both sides of the arch can be constructed simultaneously.

Arch structures having other span widths and heights may be constructed by utilizing eight of the arch modules of the preferred embodiment in combination with apex blocks of different sizes and shapes.

Although the parapet modules provide headroom for a six-foot occupant standing less than eighteen inches from the outer wall of the structure, in some applications such headroom is not needed. To reduce the volume of the structure for such applications, such as the cover of a sewage treatment pond, the parapet walls may be omitted. In such an application where methane gas may be present in large quantities, the structure may be assembled entirely with hand tools or pneumatic tools, airtight gaskets (such as Neoprene gaskets) may be utilized, and any exposed interior steel parts (such as the screws holding the interior facing panels) may be replaced with plastic.

To strengthen the structure further to meet custom requirements or very high snow or wind loading conditions, interior tensioning cables or rods may be attached between the upper attachment plates 63B on opposite sides of each arch, or interior partitions may provide further strength, or interior steel arches may be added. Lofts may likewise be suspended between upper attachment plates 63B.

The 9" thick arch modules may be factory-formed of a six-inch and a three-inch slab, adhered to each other to reduce the weight and manufacturing cost of the modules; the continuous openings 58 and 70 may then be cut with hot wires forming keyhole slots from the inside and outside of the module. The modules may be formed of other extruded foamed quasi-structural plastics, or they may be formed of structural grades of polystyrene foam, although one of the advantages of the preferred embodiment is the fact that it permits use of relatively inexpensive quasi-structural foam.

The exterior of the modules may be provided with decorative finishes, including factory-applied laminates and site-applied coatings, or the exterior of the structure may be protected with a continuous cover or with discrete claddings such as shingles. The interior facing boards may be pre-attached, although this arrangement increases the weight of the modules and also makes them more difficult to pack. Where codes permit, the interior facing may be metal, fiberglass, plasterboard or other material, or it may be omitted.

The modules may be made in different shapes; in accordance with certain aspects of the invention, for example they may be made as rectangular prisms not only for the vertical walls of half arches but for structures having only vertical walls and a gabled roof, one or both of which are formed with the connector plates and tension rods. Conversely, the vertical walls of the half arches may be formed as single foam modules without the tension rods, similar to the end wall modules.

The grooves 55 and keys 66 may have different shapes; a continuous half-round is easy to form.

The floor modules may be joined to each other by means of bridging members below the floor, and through bolts extending into the blocks 95 at the interior edges of the floor modules 91. Alternatively, the floor modules may be joined by internal latches of the sort commonly used to join foam sandwich panels. Such internal latches may also be used to hold together adjacent arches. In some of the broader aspects of the invention, such internal latches may hold together all of the foam modules of the structure, although such a construction is not preferred. In other modifications, the floor modules are eliminated, and the vault structure is erected on a concrete slab or other preformed floor. The bottom connector plates 61 may then be held to the floor by standard concrete fasteners.

The connector plates may be of different form, or may be formed of separate plates. Holes may be predrilled in the ends of the connector plates to accommodate mounting screws for the end modules, or if desired to accommodate alignment pins for connection of arch modules in adjacent arches. Although it is not preferred, because of the weight and cost increase involved, the connector plates may be wedge-shaped and the arch modules rectangular prisms; this arrangement reduces the inventory of foam block modules required if four- and five-module half arches are both being built from a stock of modules. The upper connector of each arch module may be pre-attached to the module, although this arrangement also increases the handling weight of each module.

The apex connection may be made substantially wider, for example 18" wide, to simplify attachment of the last module and provide special treatments such as skylights, vents, and the like. If the arch modules are made a full 48" tall on their inner faces, to accommodate 48" plywood facings, the 18" apex provides an interior width of 24'-2". The use of 48" interior height arch modules has the further advantage of providing a clear height of 86" at the top of the second module, simplifying the use of standard exterior doors through the first two module positions of the arch.

Large windows may easily be provided. A window module may consist of two thicker connector plates joined by four vertical posts at the corners of the connector plates. The thicker connector plates are required because the vertical posts carry rods 12 farther apart than in normal foam modules and because the nut holding the lower end of the rod must be completely inset in the lower connector plate. The same metal plates 67 as in a standard arch module may be set into the top and bottom of the connector plates, but neither the wedge washer on the upper side of the upper connector plate nor the wedge washer and nut on the lower side of the lower connector plate need be provided. Multiple glazings may be inserted into the large opening thereby provided. Preferably, the outside vertical posts are set back from the edge of the connector plates sufficiently to permit a complete glazing unit to be set flush with the exterior of the arch structure, to form a smooth exterior appearance. Additional glazing may be set behind the exterior glazing. Interior facings may cover the interior of the connector plates and the posts, and insulation may be provided around the outside of these facings.

Doors may be provided in vertical walls, or in special arch modules as in the previous Jantzen design.

The connecting tension rods may be made different sizes or of different materials, and may be positioned differently. For example, the outer rods may all be ½" in diameter and the inner rods ⅜", or all the rods may be made ½" for greater strength. A rough calculation indicates that the rods of the preferred embodiment add about twenty percent to the overall strength of the foam structure. This additional strength makes feasible the use of 1.5 pound per cubic foot extruded polystyrene rather than a structural grade of extruded polystyrene. The rods, nuts, metal mounting plates and apex ridge caps may be made of non-metallic materials for applications in which the structure must be entirely transparent to certain wavelengths of electromagnetic radiation. The tension rods may be positioned differently. Moving them to 1.5" from the inside and outside surfaces of the arch modules substantially increases the strength of the structure, but provides less thermal protection of the rods. The rods may even be placed on the outside of the modules, preferably in grooves on the surfaces of the modules, for additional strength at constant temperature, but at the cost of all thermal and environmental protection of the exterior set of rods. The tension rods may be run through plastic or metal conduit, to limit compression of the foam blocks, or wood inlays may be inset into the edges of the arch modules for the same purpose.

The tensioned rods perform both the functions of marginally strengthening the foam modules and of securing them to each other. It is possible, but not preferred, to provide separate means for connecting the modules to each other. It is also possible, but not preferred, to use tension elements, such as cables, lacking substantial compressive and flexural strength. The use of rods, rather than cables, provides a substantial strength advantage to the structure. However, the use of cable tension elements is made more feasible by the connector plates which, with their rigidity and key-and-groove interconnection with the foam arch modules, spread stresses across the entire foam modules and reduce the tendency of the tension rods from any tendency to cut through the sides of the through-holes in the foam.

These variations are merely illustrative.

I claim:

1. A building structure comprising a plurality of structural plastic foam blocks, each block having a height and a width both greater than its thickness; a top plate on an upper face of each block; a bottom plate on a lower face of each block; tension elements extending from the top plate to the bottom plate, the tension elements attaching the blocks vertically to each other; and weatherproof tape means covering seams between the blocks.

2. The structure of claim 1 wherein the tension elements are rods attached to the top plate and the bottom plate.

3. The structure of claim 2 including continuous openings extending from the top face of the foam block to the bottom face of the foam block, the rods extending through the openings.

4. The structure of claim 3 wherein the blocks are voussoirs forming at least one half-arch.

5. The structure of claim 1 wherein the blocks form the major portions of at least two walls and a roof of the structure.

6. The structure of claim 5 wherein the blocks are voussoirs forming at least one half-arch.

7. The structure of claim 5 wherein none of said blocks weighs more than about one hundred pounds.

8. The structure of claim 7 wherein substantially all of the external walls of the structure are formed of foamed plastic modules, the modules including the blocks, none of the modules weighing more than about one hundred pounds.

9. The structure of claim 8 including floor modules formed at least in part of foamed plastic, none of the floor modules weighing more than about two hundred pounds.

10. The structure of claim 1 including interior facing panels secured to the top and bottom plates.

11. A method of erecting a building structure comprising a plurality of voussoirs stacked to form at least a half-arch; the method comprising a first step of stacking a second plastic foam block on a generally vertical first plastic foam block with a first attachment means between the blocks, releasably securing the second foam block to the first foam block, thereafter a third step of stacking a third plastic foam block on the second plastic foam block with a second attachment means between the blocks, and thereafter a fourth step of releasably securing the third foam block to the second foam block to form at least a partial arch.

12. A method of erecting a building structure comprising a first step of positioning a first module in a desired position, the module having an upper face and a lower face, a second step of tightening tensioning means extending from the upper face to the lower face of the first module to place the first module in compression, a third step of mounting a second module above the first module, the second module having an upper face and a lower face, and a fourth step of tightening tensioning means extending from the upper face to the lower face of the second module to place the second module in compression, the first module and the second module being separated by a plate, the second step comprising tightening tension rods extending through the plate, and the fourth step comprising tightening tension rods into threaded openings in the plate.

13. The method of claim 12 wherein the fourth step also connects the second module to the first module.

14. The method of claim 12 wherein the tension means of the fourth step comprise four rods.

15. The method of claim 12 wherein the fourth step comprises extending the rods through openings in the second module, the rods being contained within the second module.

16. The method of claim 12 wherein the modules are made of plastic foam, the modules being compressed and reinforced in the second and fourth steps to an extent to increase their resistance to bending by at least 20%.

* * * * *

UNITED STATES PATENT AND TRADEMARK OFFICE

CERTIFICATE OF CORRECTION

PATENT NO. : 5,323,573
DATED : June 28, 1994
INVENTOR(S) : Edward L. Bakewell

It is certified that error appears in the above-indentified patent and that said Letters Patent is hereby corrected as shown below:

Column 6, Line 52, delete "4" " and insert -- 41" --

Signed and Sealed this

Sixth Day of December, 1994

*Attest:*

Bruce Lehman

BRUCE LEHMAN

*Attesting Officer*

*Commissioner of Patents and Trademarks*